US005558612A

United States Patent [19]

Blümle

[11] Patent Number: 5,558,612

[45] Date of Patent: Sep. 24, 1996

[54] APPARATUS FOR THE CONTINUOUS PRODUCTION OF AN ARTICLE OF MANUFACTURE, SUCH AS ENVELOPES

[75] Inventor: Martin Blümle, Horhausen, Germany

[73] Assignee: Winkler & Duennebier Maschinenfabrik und Eisengiesserei KG, Neuwied, Germany

[21] Appl. No.: 246,832

[22] Filed: May 20, 1994

Related U.S. Application Data

[63] Continuation-in-part of Ser. No. 839,108, Feb. 20, 1992.

[30] Foreign Application Priority Data

May 21, 1993 [DE] Germany ..... 43 17 071.4

[51] Int. Cl.[6] ..... B31B 1/54

[52] U.S. Cl. ..... 493/177; 493/178; 493/180; 493/183

[58] Field of Search ..... 493/227–233, 493/235, 236, 243, 255, 261–264, 244, 245, 177, 178, 180–183, 256, 257, 259

[56] References Cited

U.S. PATENT DOCUMENTS

| | | | |
|---|---|---|---|
| 543,571 | 7/1895 | Crist . | |
| 971,780 | 10/1910 | Parrish . | |
| 2,012,357 | 8/1935 | Shea . | |
| 2,153,848 | 4/1939 | Shea et al. . | |
| 2,159,853 | 5/1939 | Johnson | 493/256 |
| 2,570,047 | 10/1951 | Burroughs | 493/256 |
| 4,582,552 | 4/1986 | Fitzgibbon | 493/177 |

*Primary Examiner*—Jack W. Lavinder
*Attorney, Agent, or Firm*—W. G. Fasse; W. F. Fasse

[57] ABSTRACT

An article of manufacture, such as letter envelopes, paper bags, shipping pouches, and the like is manufactured continuously on a production line that includes a back folding or so-called zig-zagging station which folds back one of the bottom flaps, first in a direction opposite to the continuing feed advance and then in the direction of the feed advance, whereby the formation of so-called bed bottoms or stand-up bottoms for these articles is facilitated. A cross strip (43) of a front or back portion of the article and respective pre-creases are used as a folding arm and fold lines in the formation of the zig-zag fold.

13 Claims, 9 Drawing Sheets

APPARATUS FOR THE CONTINUOUS PRODUCTION OF AN ARTICLE OF MANUFACTURE, SUCH AS ENVELOPES

CROSS-REFERENCE TO RELATED APPLICATIONS

The present application is a Continuation-In-Part application of U.S. Ser. No.: 07/839,108, filed on Feb. 20, 1992, entitled: METHOD FOR CONTINUOUSLY PRODUCING ENVELOPES, BAGS, AND SHIPPING POUCHES, AND THE PRODUCT SO PRODUCED; refiled as FWC No. 08/240,540, now U.S. Pat. No. 5,478,302; issued Dec. 26, 1995.

FIELD OF THE INVENTION

The invention relates to a folding apparatus for continuously producing a bed bottom or stand-up bottom in continuously produced articles of manufacture, especially made of paper, plastic or the like, such as letter envelopes, shopping bags, shipping pouches and the like. The material is a sheet material either in the form of an advancing continuous web or in the form of precut individual sheets. Tubular members are formed in both instances.

BACKGROUND INFORMATION

Such articles of manufacture have at least one front portion, a back portion, and a stand-up or so-called bed bottom with at least one bottom flap and, if desired, a closure flap. These articles are manufactured on machines having several stations for the production of precreases, for the cutting of certain contours, and for the application of an adhesive, as well as for folding and severing of the articles from a continuous web of materials or for the respective operational steps to be performed on precut individual blanks. Regardless whether the articles are 20 manufactured of a continuous web or of precut blanks, the articles may be prepared with or without side folds or side pleats. The gluing may be made along side pleats or along a center strip. Further, these articles comprise a folded and glued square or rectangular stand-up bottom which is also referred to as bed bottom or cross-bottom. During the production the precut blank or the web material is first precreased and precut to the extent necessary followed by adhesive application, folding, severing, to prepare a tubular or hose shaped blank which finally is closed at its bottom. For this purpose the apparatus for manufacturing such articles comprises several stations which are arranged in sequence with due regard to the steps that the particular station is performing so that all stations can cooperate. Especially the station for producing the bed bottom or stand-up bottom is complicated in its structural components and hence involved so that it is difficult to produce the same high production numbers per minute as is possible in the other stations of the apparatus. In other words, the bottom forming station constitutes the weak link in the chain of stations of the entire apparatus because heretofore it was not possible to operate the bottom forming and closing station as fast as the other stations.

OBJECTS OF THE INVENTION

In view of the above it is the aim of the invention to achieve the following objects singly or in combination:

- to provide an apparatus that can continuously produce the above mentioned articles without a slow down in any of the stations to produce so-called bed or stand-up bottoms during a continuous feed advance of the blank even when performing the steps for the bottom formation;
- to avoid a conventional complicated bed bottom formation;
- to simplify the station of the apparatus that forms the bed bottom so that its uncomplicated structure can operate at a speed compatible with the speed of the other stations of the production apparatus; and
- to provide a particular folding sequence that will permit simplifying the folding station for forming the bed bottom.

SUMMARY OF THE INVENTION

The above objects have been achieved according to the invention by a zig-zag backward folding mechanism in the bed bottom formation stage of the system for a backward, zig-zag shaped folding of the bottom flap of the article, whereby part of the front or back side of the article may participate in the formation of the zig-zag fold.

The zig-zag folding mechanism is arranged as a special station in the sequence of manufacturing stations of the system for making the present articles, whereby the arrangement is such that a continuous production sequence does not need to be interrupted for the bottom formation. Further, the motion direction of the blanks in the bed bottom forming station or mechanism according to the invention is retained throughout the manufacturing sequence of steps so that a rotation or turning of the blanks is not necessary. The backward folding takes place continuously and automatically without a reduction in the feed advance speeds of the blanks compared to the feed advance in the other stations of the manufacturing system.

The present back folding mechanism performs the zig-zag shaped back folding on the blank after the continuous web blank or the precut blank have been formed into a hose or tubular configuration.

According to a preferred embodiment of the present apparatus at least one suction element is provided for gripping a back foldable bottom flap and lifting this flap substantially in parallel to the transport plane while the tubular blank, either a precut blank or a continuous web blank, is continuously moving in the forward direction. Simultaneously, at least one folding knife with its folding edge fixes a back folding precrease so that the bottom flap may lie itself onto the article portion to be produced after the suction element is lowered. The web or precut blank is kept moving while the suction element or member is being lowered and the suction element finally releases the bottom flap as soon as the zig-zag shaped back folding step is completed.

According to a further embodiment of the invention, several simultaneously effective suction elements and several folding knives which are also simultaneously effective are arranged to cooperate with each other in order to assure that the bottom flap is folded back in a zig-zag shape in a faultless manner.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
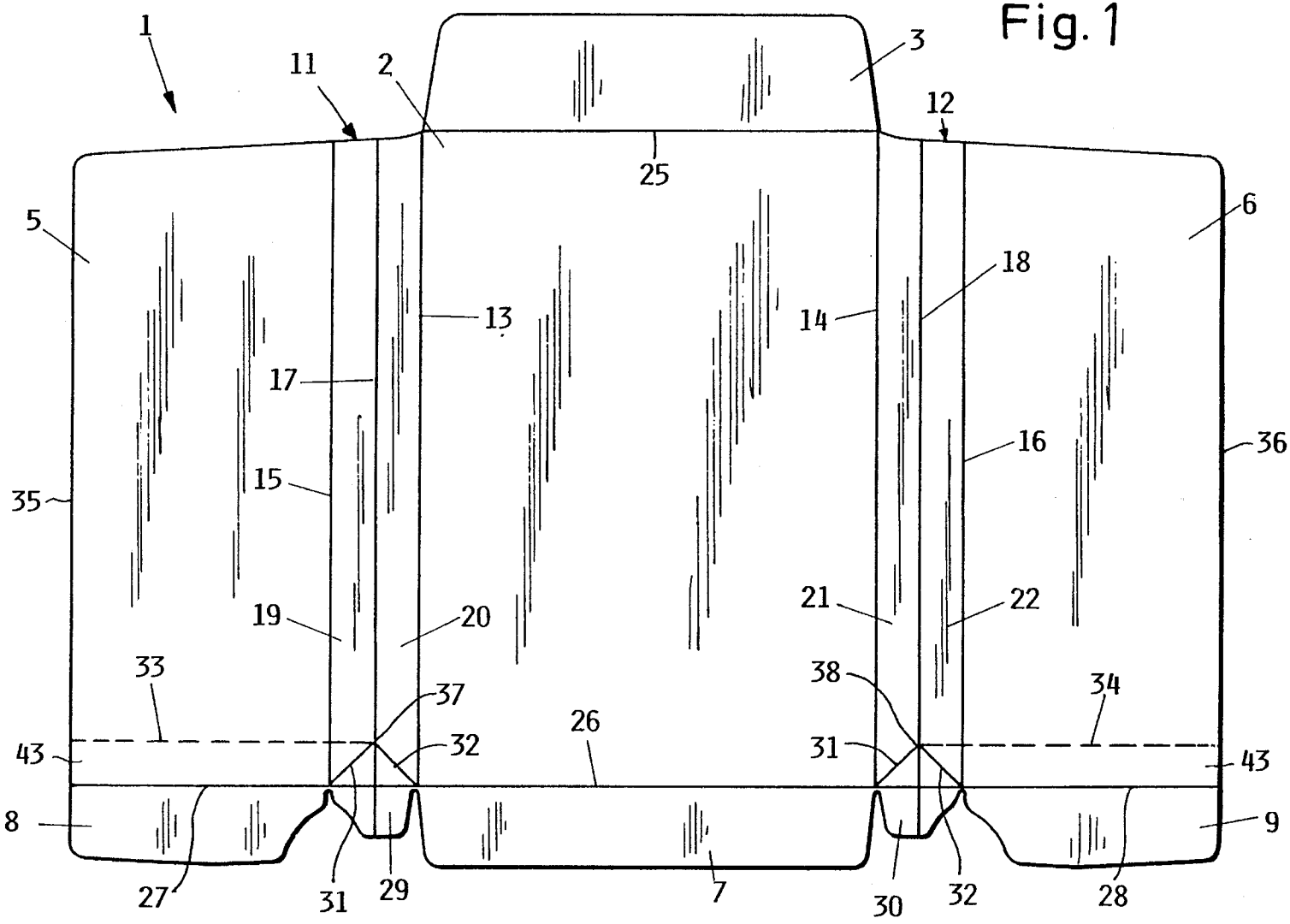
FIG. 1 is a developed view of a precut blank for an article of manufacture produced by the apparatus of the invention.
Figure 2:
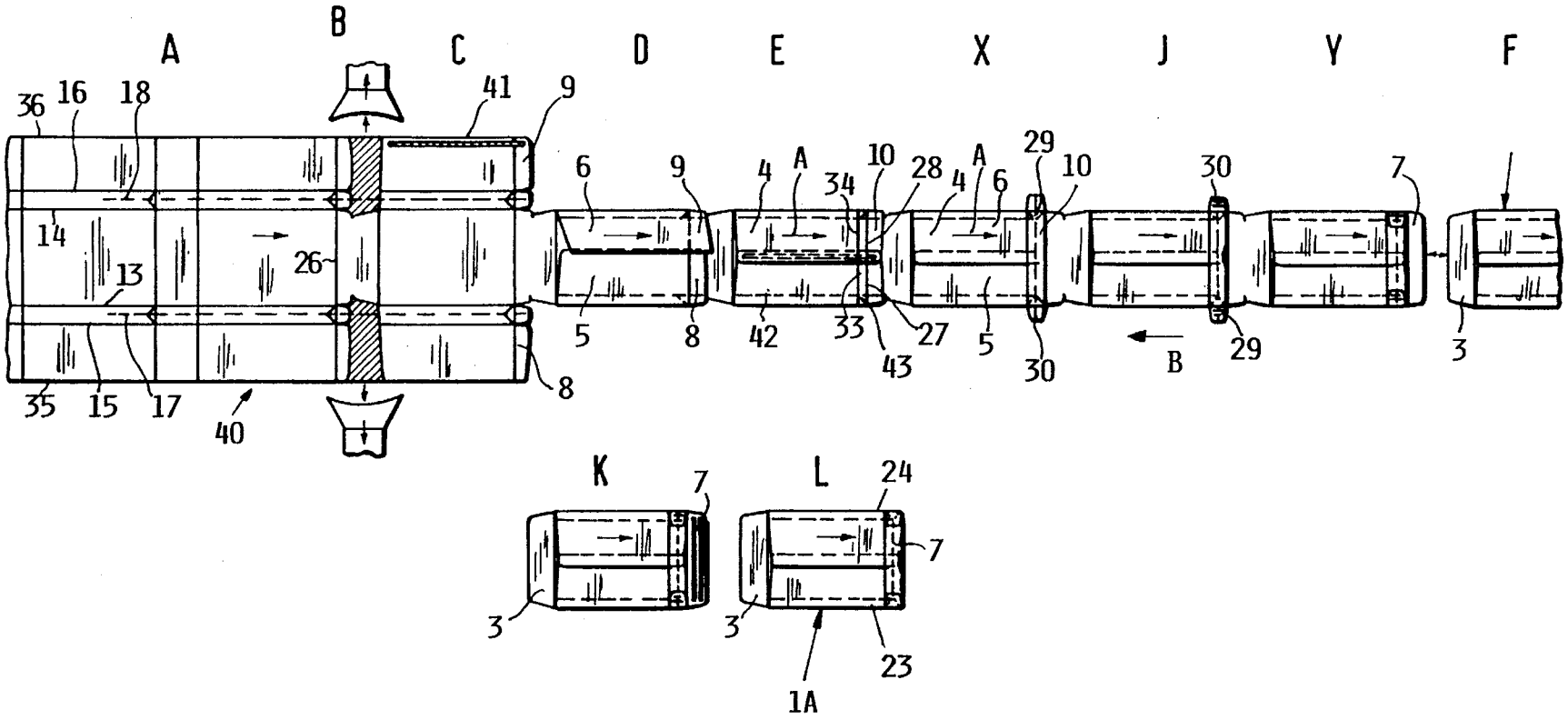
FIG. 2 illustrates a sequence of manufacturing steps performed by the present system.

FIG. 1 shows a developed view of a blank 1 for producing an article 1A of manufacture shown in FIG. 2. The blank 1 of FIG. 1 has a front portion 2 for example with a closure flap 3 and two back half sections 5 and 6 for forming a back portion 4. The blank 1 further has a bottom flap 7 and bottom flap halves 8 and 9 respectively arranged at the bottom sides of the back half sections 5 and 6. As soon as the back half sections 5 and 6 have been connected to each other by a central adhesive bond strip to be described below, the precut blank 1 has been transformed into a tubular blank, whereby the two bottom flap halves 8 and 9 form a bottom flap 10 forming part of the back portion 4 of the article. In the sequence of steps A, B, C, D, E, X, J, Y, F, K, and L shown in FIG. 2 the back portion 4 is on top, namely facing the viewer, please see steps D and E.

The blank 1 further comprises a side section 11 or 12 or rather two such side sections between the front portion 2 and the respective back half sections 5 and 6. These side sections 11 and 12 form side folds or pleats which require several precreases in the shape of a front longitudinal precrease 13 or 14 and a respective back portion longitudinal precrease 15 and 16 as well as one central longitudinal precrease 17 and 18 for forming the side pleats. The longitudinal precreases 13, 14, 15, 16, 17 and 18 divide the side portions or sections 11 and 12 into longitudinal fold pleats 19 and 20 and 21, 22. These longitudinal fold pleats are arranged in pairs to form the side folds or pleats 23, 24 as is also shown in FIG. 2, please see step L.

Further, the blank 1 comprises several cross precreases, including a closure flap cross precrease 25, a bottom flap cross precrease 26, and an extension of the latter in the form of cross precreases 27 and 28 which define the bottom flap halves 8 and 9. The bottom flap cross precrease 26 extends further straight out through the bottom side tongues 29, 30 which form an extension of the side sections 11 and 12, please see FIG. 1.

Angular precreases 31 and 32 are provided in the bottom of the side sections 11 and 12. A back folding precrease 33, 34 extends in parallel to the cross precreases 27 and 28 respectively. The precreases 33 and 34 extend through the bottom portions of the back sides 5 and 6. Each of the back folding precreases 33 and 34 extends from the respective outer edge of the backsides 5 and 6 to the intersection 37, 38 of the angular precreases 31, 32 with the respective central longitudinal precreases 17 and 18 of the side sections 11 and 12.

FIG. 2 illustrates the sequence of manufacturing steps for producing the article 1A by starting with a web material 40 rather than with a precut blank.

Referring to FIG. 2, step A involves the formation of the longitudinal precreases 13, 14, 15, 16, 17 and 18 and the formation of the cross precreases 25, 26, 27 and 28 as well as the angular precreases 31 and 32 in the blank material 40. Step B involves the formation of the required cuts. In step C the side flap 6 is provided on its inwardly facing surface with an adhesive track 41. The side flaps 5 and 6 are then folded over in step D so that a hose type or tubular web section 42 can be formed in step E. The two bottom flap halves 8 and 9 now form together a backside bottom flap 10 that will cooperate with the front bottom flap 7 in the formation of the bed bottom in which the side tongues 29 and 30 will also participate as will be described below. The final fold assures that the tongues 29, 30 will be glued in place in the folded state between the bottom flaps 7 and 10. This is an important advantage of the invention because in the prior art the side tongues are glued to the outside of one of the bottom flaps resulting in a weaker bond because the side tongues are merely fully bonded to one bottom flap but not to both.

Figure 9:
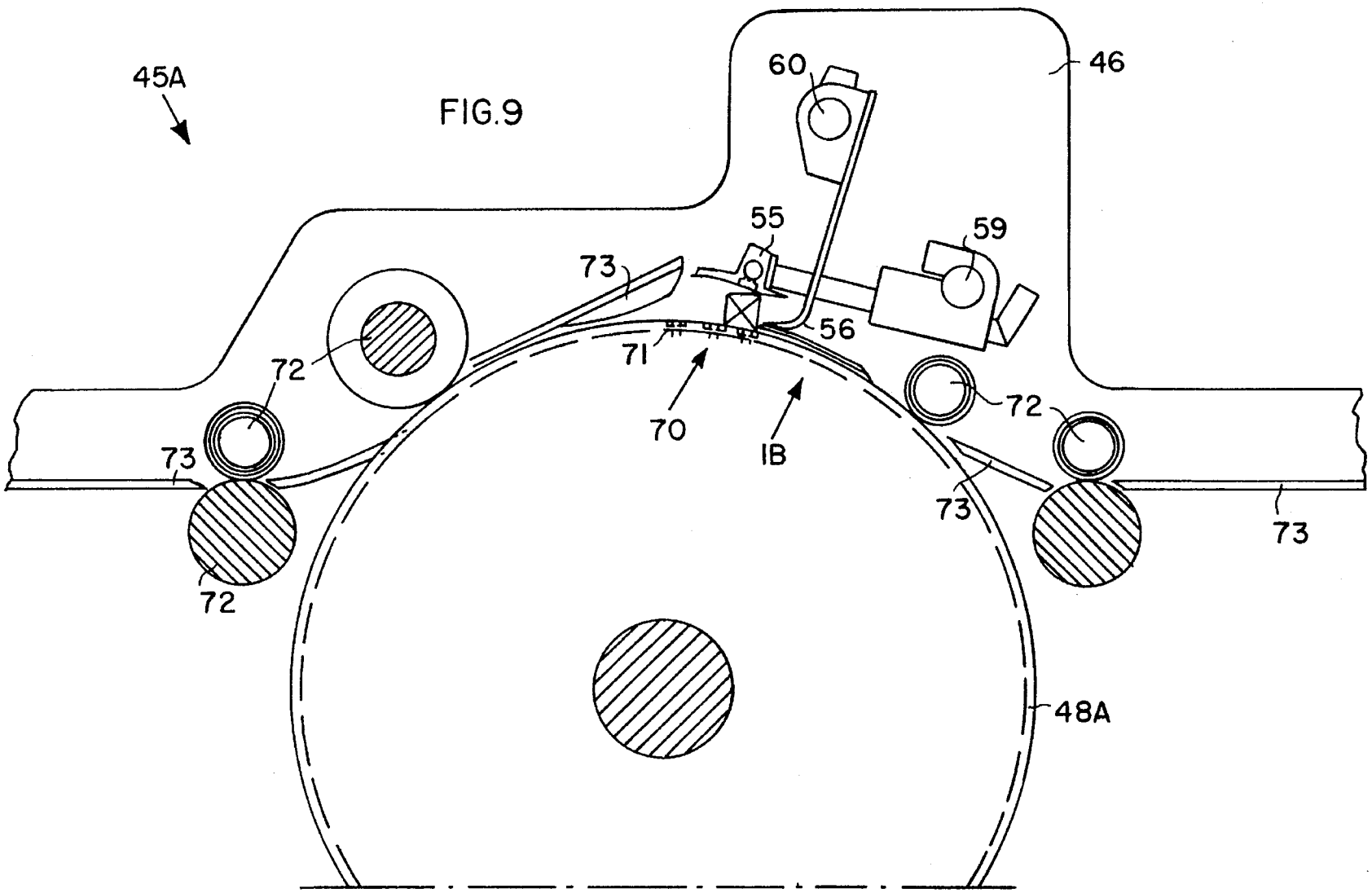
FIG. 9 shows, on an enlarged scale a schematic illustration as in FIG. 2, but showing a modified embodiment for the zig-zag back folding bottom flaps of precut hose-shaped blanks.

During step X the rear bottom flap 10 is set back in a zig-zag configuration indicated by the arrow B which is opposite to the transport direction indicated by the arrow A. The set back or back folding is performed substantially parallel to the surface of the hose-shaped web section 42. Such back folding positions the bottom flap 10 formed of the two bottom flap halves 8 and 9 onto the outer surface of the back portion 4 formed by the two back half sections 5 and 6. Simultaneously, the bottom side tongues 29 and 30 flap outwardly as shown in FIG. 2 at step X. Step X may be performed, as shown in FIG. 2, at a time when the tubular web section 42 is still connected to the entire tubular material 40. In the alternative, step X may be performed on a blank that has already been severed. Such a severed blank 1B is shown in FIG. 9. According to FIG. 2, the severing of the article 1A takes place between steps Y and F that is following step X. However, the severing of the blank 1B may take place prior to step X as mentioned.

Referring further to FIG. 2, steps J, Y, F, K and L are performed to the extent necessary including the application of adhesive, the folding and adhesive bonding, until the finished article 1A is provided at step L. The zig-zag shaped back setting or back folding of the bottom flap 10 tilts the bottom flap around the fold back precreases 33, 34 shown in FIG. 1. The bottom flap 10 lays itself against the tubular web section 42 and against a cross strip 43 that is also folded back or flipped over as part of the back portion 4 of the article. The cross strip 43 is positioned between the cross precreases 27 and 28 on the one hand and between the back folding precreases 33 and 34 on the other hand, please see step E in FIG. 2. This back portion cross strip 43 forms a back folding section that functions as a tilting arm for the bottom flap 10.

Figure 3:
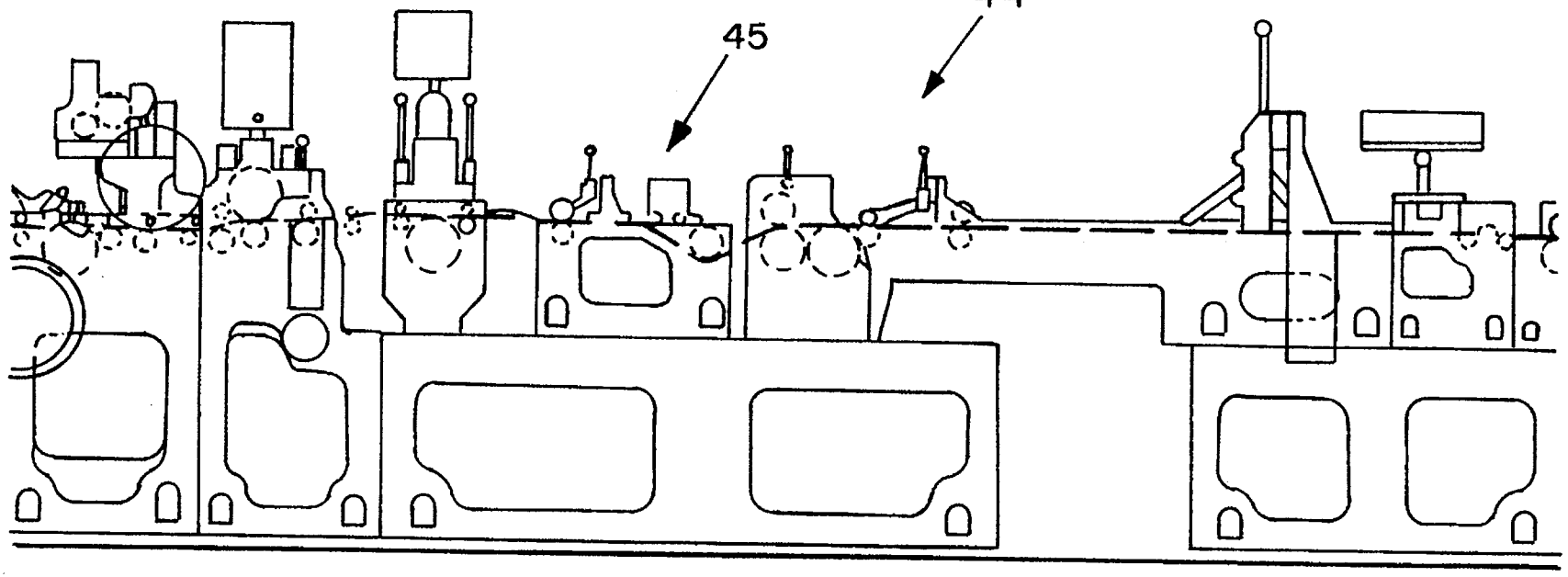
FIG. 3 shows, on a reduced scale, a schematic side view of a system in which the back folding mechanism according to the invention is incorporated.

FIG. 3 shows several stations of an apparatus 44 for performing the steps of FIG. 2. The apparatus 44 comprises a back folding mechanism 45 according to the invention for performing the zig-zag shaped back folding operation on the cross strip 43 and thus also on the bottom flap 10. Except for the back folding mechanism 45, all other stations of the apparatus 44 are not part of the invention.

Figure 4:
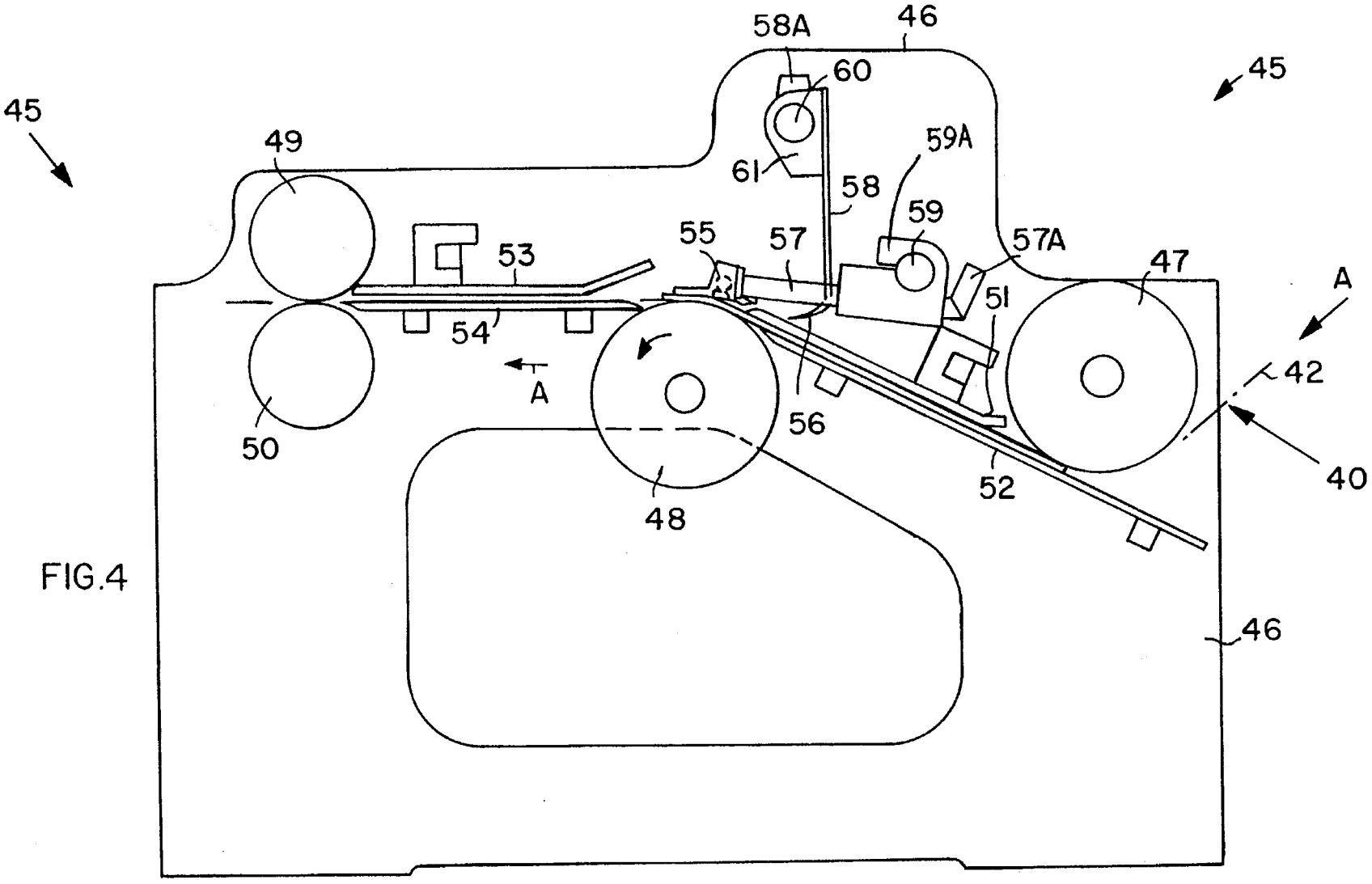
FIG. 4 illustrates, on an enlarged scale compared to FIG. 3, the station of the present mechanism for the zig-zag shaped back folding of a continuous web blank.

The back folding mechanism 45 comprises according to FIG. 4, machine frame walls 46 for supporting a detour roller 47 for the web material 40, whereby the material 40 is supplied to the detour or guide roller 47 still as a continuous tubular web section 42. Further, a drive roller 48 and a pair of pressure rollers 49 and 50 as well as guide elements 51, 52, 53 and 54 are provided upstream and downstream of the drive roller 48 as viewed in the feed advance direction A of the web section 42.

The back folding mechanism 45 further comprises at least one suction element 55 and a folding knife or member 56. The suction element 55 and the folding member 56 are arranged on first and second support arms 57, 58, respectively. The first support arm 57 of the suction element 55 is tiltably mounted to the machine frame 46 on a journal shaft 59 for tilting the suction element 55 about the journal shaft 59. The mounting arm 58 of the folding member 56 is journalled to a journal shaft 60 also secured to the machine frame 46. The position of the journal shaft 59 and 60 is such that the respective arm 57 and 58 can perform substantially a vertical up and down movement or a horizontal back and forth movement. The arms 57 and 58 are driven by respective drives 57A and 58A for performing the respective tilting motion around the journal shafts 59 and 60 respectively. However, instead of the tilting drives, piston cylinder devices could be used for operating the suction element and the folding knife.

Figure 8:
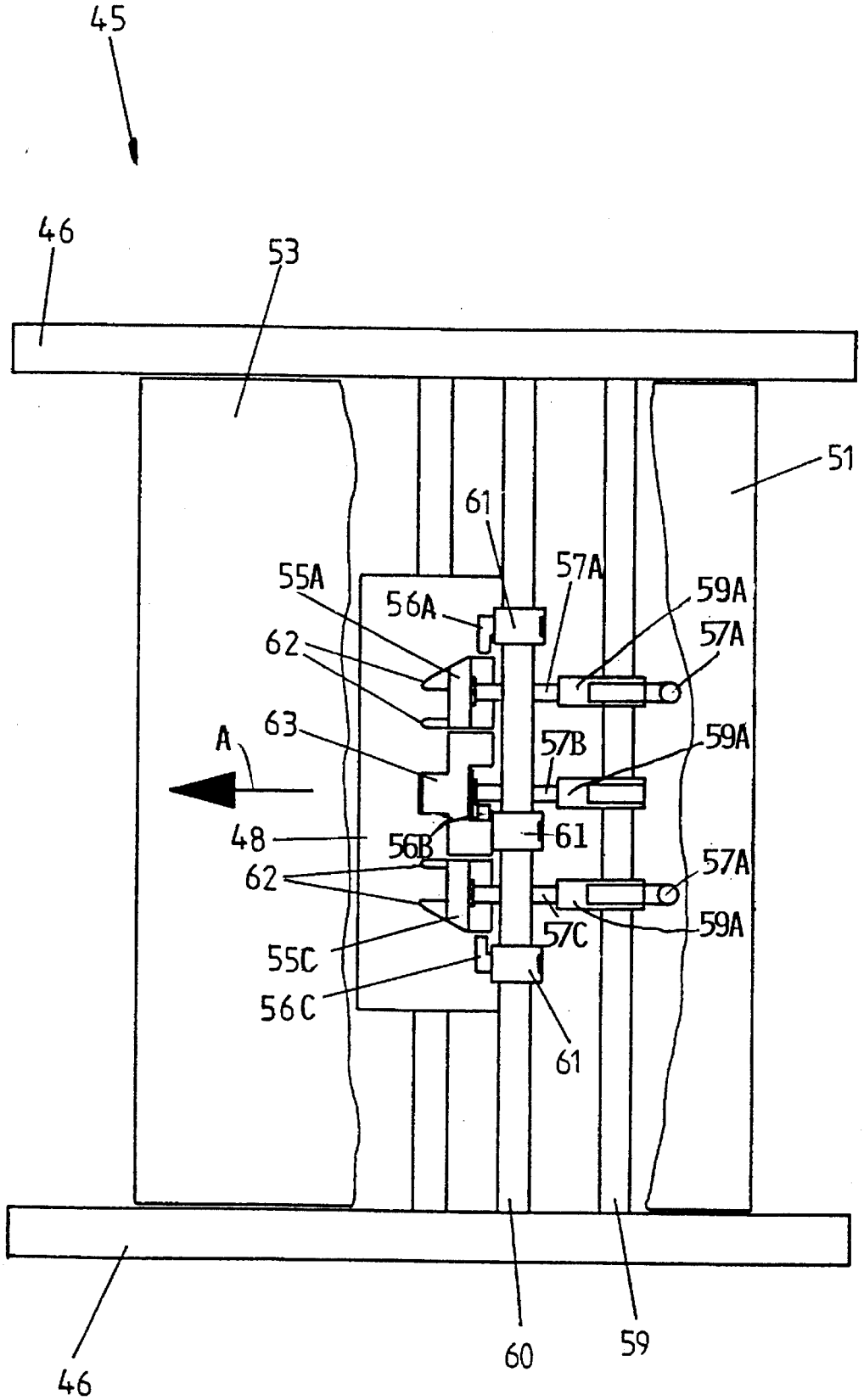
FIG. 8 shows a schematic top plan view onto the elements of the back folding mechanism.

The top plan view of FIG. 8 shows three folding members 56A, 56B and 56C mounted with respective brackets 61 on the journal shaft 60. Preferably, the brackets 61 are adjustable along the length of the journal shaft 60 to accommodate material 40 of different widths. The folding members 56A and 56C are positioned near the outer edges of the material 40 so that the respective knives are effective near the margin of the tubular web section 42. The folding member 56B is preferably but not necessarily located centrally. The carrier arms 57A, 57B and 57C are mounted by respective brackets 59A to the journal shaft 59. Preferably these brackets 59A are also position adjustable along the length of the journal shaft 59 for accommodating material of different width. The arms 57A and 57C carry respective suction elements 55A and 55C. The central arm 57B carries a folding plate 63. Each suction element 55A and 55C carries suction cups facing with their suction openings the drive roller 48. Each of the suction elements 55A and 55C carries two fingers 62 for facilitating the intended zig-zag folding. The folding plate 63 may be replaced by a centrally arranged suction element not shown.

The function and operation of the zig-zag back folding mechanism 45 according to the invention will now be described with reference to FIGS. 5, 6 and 7.

Figure 5:
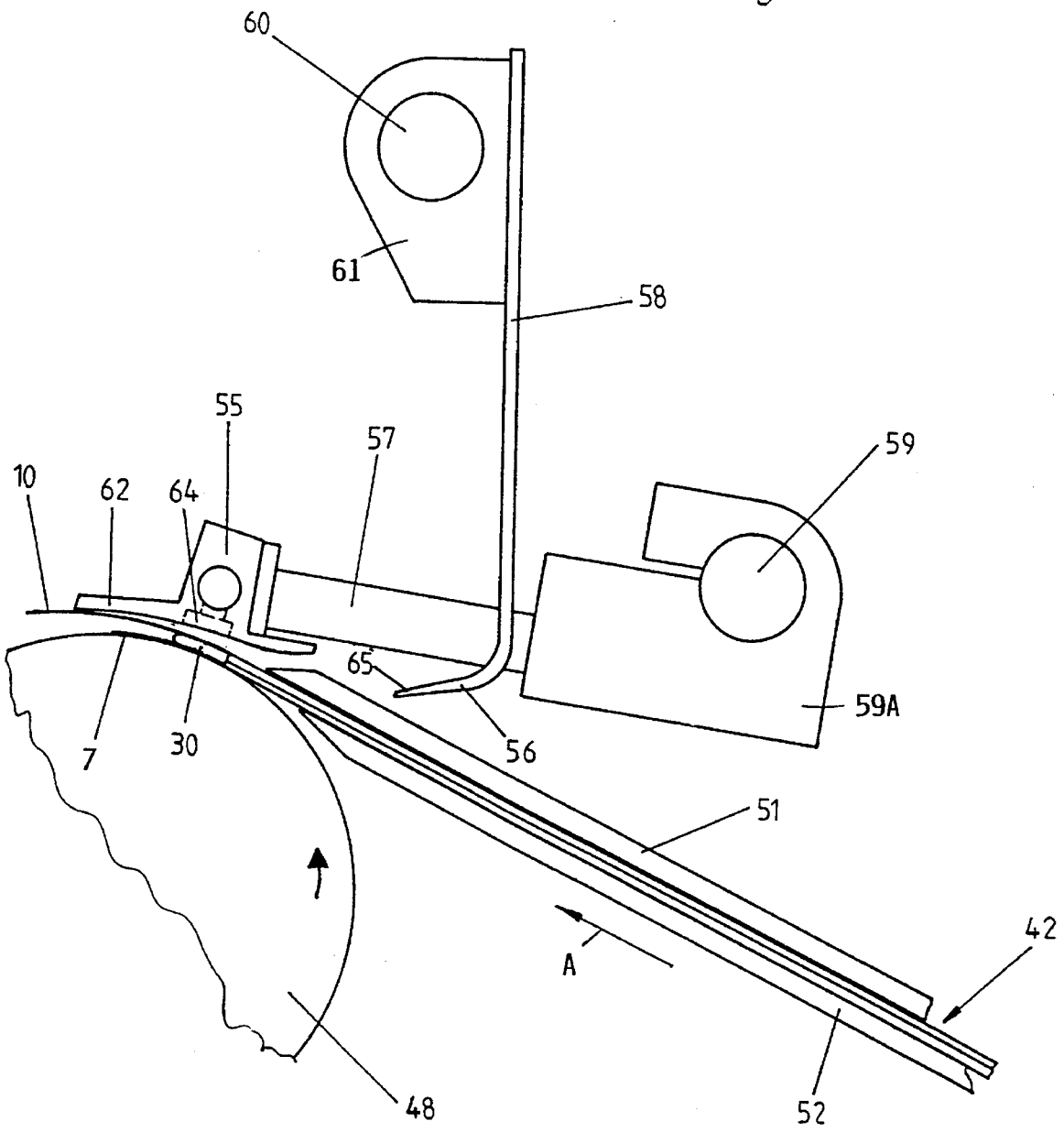
FIG. 5 illustrates a side view, on a further enlarged scale, of a detail of the back folding mechanism of FIG. 4 with a suction element in the effective suction position for gripping a forward moving bottom flap that is back foldable in a zig-zag configuration and with a folding knife in its backward or waiting position.

FIG. 5 shows that a tubular web section 42 not yet severed from the web material 40 is positioned between two guide elements 51 and 52, whereby the bottom flap 10 is leading in the feed advance direction A, whereby the bottom flap section 10 is positioned directly under the suction opening or openings 64 of the suction element 55. The other bottom flap 7 forming part of the front portion 2 of the article is supported by the drive roller 48 at this time. The bottom side tongues 29 and 30 are partially folded at this time and are positioned between the two bottom flaps 7 and 10 thereby later providing a stronger bed bottom than is conventionally possible. Only bottom side tongue 10 is visible in FIGS. 5 and 6. The suction element or elements 55 are in a down position as seen in FIG. 5, while the folding member 56 or the folding knives or members are still in their backward or waiting position so that the folding edge 65 of the folding member 56 is in a withdrawn position.

Figure 6:
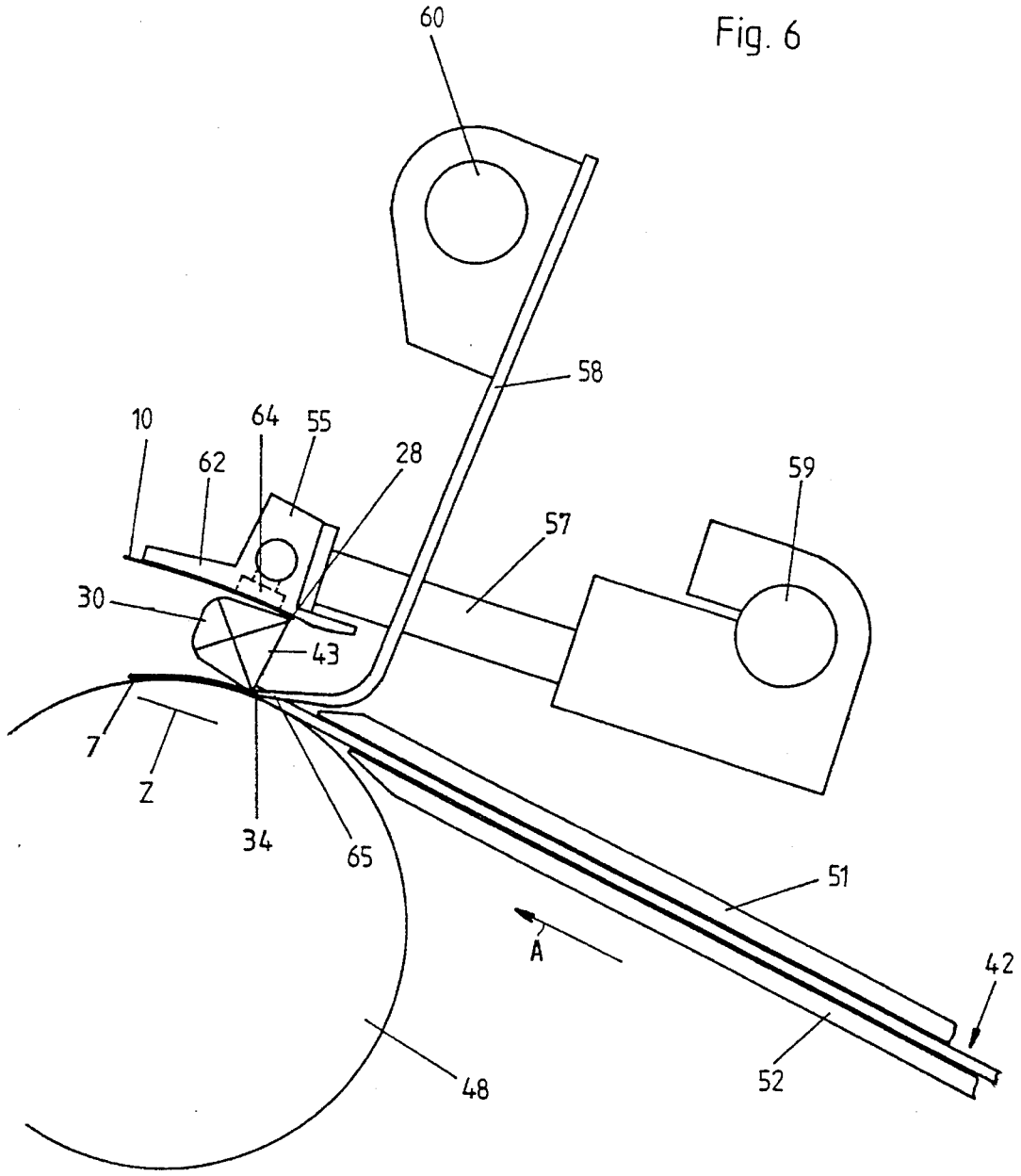
FIG. 6 is a view similar to that of FIG. 5, but showing the suction element in its elevated position, whereby simultaneously the folding knife bears with its folding edge against a back folding precrease.
Figure 7:
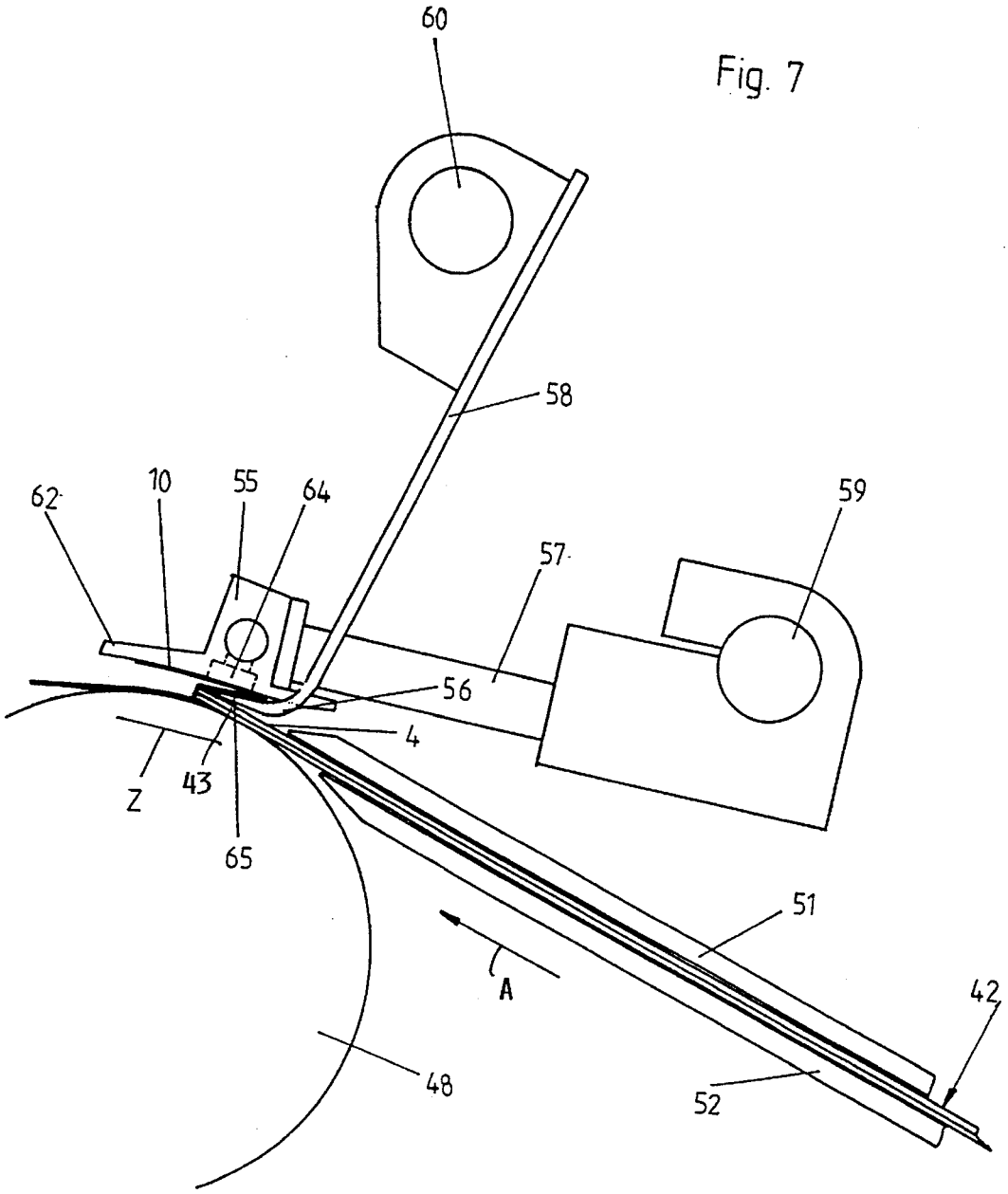
FIG. 7 shows a detail as in FIGS. 5 and 6, whereby the suction element is again almost in its fully lowered position and the folding knife with its folding edge still bears against the back fold crease just prior to the back tilting.

Referring to FIG. 6, the suction elements 55 have now raised the bottom flap 10 thereby unfolding the side tongues 29 and 30, whereby the bottom flap 10 extends substantially in parallel to the transport direction A or to a tangential plane Z of the transport or drive roller 48. As a result, the back cross strip 43 also shown in FIG. 2 at step E, has assumed a substantially raised position relative to the tubular web section 42.

Simultaneously, the bottom side tongues 29 and 30 are also tilted into an open raised position as seen in FIG. 6. The folding knife or knives 56 tilt into their working position by moving the arm 58 clockwise about the journal shaft 60, whereby the folding edge 65 bears against the back folding precreases 33, 34 positioned between the back cross strip 43 and the bottom flap 7 as shown in FIG. 6. During the next working step, the suction elements 55 are lowered again by tilting the arm 57 counterclockwise about the journal axis of the journal shaft 59. While the suction element or elements 55 move downwardly, the folding edge 65 of the folding member 56 keeps travelling with the web 42 in the direction A so that the edge 65 keeps contacting the back folding precreases 33, 34 as long as possible, whereby the back fold portion strip 43 is folded in the zig-zag fashion to assume the position of FIG. 7 by folding clockwise and downwardly about the precrease 33, 34. As a result, the strip 43 now rests against the back portion 4 When the suction elements 55 have tilted back into the down position. Simultaneously, the bottom flap 10 has come to rest on the cross strip 43, whereby the zig-zag back folding operation of the bottom flap 10 is completed.

While the suction elements 55 lift the bottom flap 10, the tubular web section 42 keeps travelling in the direction A, whereby the zig-zag backward folding is completed when the suction element or elements 55 again lower the bottom flap 10. During this folding operation the folding member or members 56 and the plate 63 primarily have a stabilizing function.

FIGS. 4, 5, 6 and 7 further show that the arms 57 of the suction elements 55 and the arms 58 of the folding members 56 are extending approximately perpendicularly to each other in the backward waiting position and in the working position. Further, the journal axes 59 of the suction elements 55 and the journal axis 60 of the folding knives extend in parallel to the transport plane of the web section 42 and across the transport direction A of the section 42. The folding edge 65 of the folding members 56 tapers toward the free end for a proper folding assistance.

FIG. 9 illustrates a modification of the present back folding mechanism which works on precut individual blanks formed into tubular sections as compared to continuous tubular web pieces 42 which are processed in the apparatus of FIGS. 4 to 7. The suction elements 55 and the folding member 56, as well as their mounting and their drives are the same in all embodiments 45 and 45A. The drive roller 48A of the second embodiment 45A is constructed as a suction roller provided with a suction device 70 having suction openings 71 for holding individual blanks 1B. The suction hole 71 may be replaced by a suitable gripper mechanism. In both instances the individual blanks 1B are properly held on the surface of the drive roller 48A. Additional guide rollers 72 cooperating with the drive roller 48A make sure that the individual blanks 1B properly travel as intended. Similarly, guide blades 73 cooperate for properly guiding the individual blanks along their path from right to left in FIG. 9.

The product produced on the apparatus of FIG. 9 is a letter envelope, the back portion 4 of which comprises also two back sections 5 and 6 as shown in FIG. 1. These sections are joined to each other by a center glue track 41 as described. The back portion 4, however, may also be a single piece which is secured by a side adhesive bonding with the front portion or with another side portion 11 or 12. Further, it is possible that the product does not have any side folds or pleats 23, 24 as shown in FIG. 2 at step L. The product 1A may thus assume many different embodiments in each of which a Z or zig-zag shaped back folding of the bottom flap 10 is performed by using the back cross strip 43 as a folding arm. Thus, the invention is not limited to the production of very specific products. Nor is the present invention limited to the specific embodiments shown. Rather, other modifications with regard to the shape, size or construction of the articles are possible. For example, an embodiment of the invention can use suction elements 5 which perform a linear or at least partly linear stroke motion rather than a tilting motion. Similarly, the drive roller 48A of FIG. 9 with its suction device 71 may also be used in the embodiment 45 of FIGS. 4 to 7.

Although the invention has been described with reference to specific example embodiments, it will be appreciated that it is intended to cover all modifications and equivalents within the scope of the appended claims.

What is claimed is:

1. Apparatus for continuously forming a stand-up or bed bottom in an article of manufacture made of sheet material having precreases for forming said stand-up bottom, comprising a drive device for transporting said sheet material through said apparatus in a feed advance direction, and a back folding mechanism (55, 56) cooperating with said drive device for folding a first portion (43) of said sheet material about a first precrease (33, 34) in a direction opposite to said feed advance direction (A), and for folding a second portion (8, 9, 10) of said sheet material forming part of said stand-up bottom about a second precrease (27, 28) in said feed advance directions (A), whereby a zig-zag fold is formed, wherein said back folding mechanism comprises at least one suction member (55) for lifting said second portion (8, 9, 10) while said sheet material is advancing, whereby said first portion (43) is folded back opposite to said feed advance direction and said second portion (8, 9, 10) is folded forward, and at least one folding member positioned for cooperation with said suction element (55) in producing said zig-zag fold.

2. The apparatus of claim 1, wherein said back folding mechanism comprises a plurality of suction elements (55A, 55B, 55C) for lifting said second portion while said sheet material is advancing, whereby said first portion (43) is folded back opposite to said feed advance direction and said second portion (8, 9, 10) is folded forward, and a plurality of folding knives positioned for cooperation with said plurality of suction elements in producing said zig-zag fold.

3. The apparatus of claim 2, further comprising first and second journals (59, 60) and first and second tilting arms (57, 58) respectively mounted to said journals, each of said suction elements (55) being mounted to a free end of a respective first tilting arm (57), each of said folding knives being mounted to a free end of a respective second tilting arm (58), so that said suction elements and said folding knives are tiltable about the respective journal with the respective tilting arm forming a tilt radius, and drive means for operating said tilting arms.

4. The apparatus of claim 3, wherein said first and second tilting arms are so mounted relative to each other that said first tilting arms extend approximately perpendicularly to said second tilting arms and vice versa in a rest position and in a working position of said arms.

5. The apparatus of claim 4, wherein each of said journals (59, 60) has a journal axis extending in parallel to a plane defined by said sheet material and cross-wise to said feed advance direction.

6. The apparatus of claim 6, wherein said journal axes are extending in parallel to each other.

7. The apparatus of claim 1, wherein said folding member or members has a folding edge (65) pointing substantially in said feed advance direction.

8. The apparatus of claim 1, wherein said folding member has a forward folding edge that contacts said first precrease (33, 34).

9. The apparatus of claim 1, wherein said article has a back side and said second portion (8, 9, 10) forms a bottom flap (10) as part of said back side, said suction member (55) being so positioned that it contacts an outwardly facing surface of said bottom flap (10) for lifting said bottom flap (10).

10. The apparatus of claim 9, further comprising drive means (57, 59, 57A, 59A) connected to said suction member (55) for operating said suction member (55) so that said suction member (55) is first lifted with said bottom flap (10) as said feed advance continues and then again lowering said suction member (55) with said bottom flap (10) to complete said zig-zag fold.

11. The apparatus of claim 10, wherein said drive means lift and lower said suction member (55) at least partly along an approximately linear motion path.

12. The apparatus of claim 1, wherein said drive device comprises a drive roller (48, 48A) positioned below said back folding mechanism.

13. The apparatus of claim 13, wherein said drive roller has suction openings in its circumferential surface for transporting articles.

* * * * *

UNITED STATES PATENT AND TRADEMARK OFFICE

CERTIFICATE OF CORRECTION

PATENT NO. : 5,558,612

DATED : September 24, 1996

INVENTOR(S) : Martin Bluemle

It is certified that error appears in the above-identified patent and that said Letters Patent is hereby corrected as shown below:

Column 1, line 37, delete "20".

Column 6, line 38, replace "When" by --when--.

Column 8, Claim 6, line 1, replace "claim 6," by --claim 5,--.

Signed and Sealed this

Third Day of December, 1996

*Attest:*

*Attesting Officer*

Bruce Lehman

BRUCE LEHMAN

*Commissioner of Patents and Trademarks*